US008167636B1

(12) United States Patent
Montena

(10) Patent No.: US 8,167,636 B1
(45) Date of Patent: May 1, 2012

(54) CONNECTOR HAVING A CONTINUITY MEMBER

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 19 days.

(21) Appl. No.: 12/905,654

(22) Filed: Oct. 15, 2010

(51) Int. Cl.
*H01R 4/38* (2006.01)

(52) U.S. Cl. ..... 439/322; 439/95

(58) Field of Classification Search ..... 439/322, 439/578, 320, 323, 313, 312, 314, 585, 95
See application file for complete search history.

(56) References Cited

U.S. PATENT DOCUMENTS

| | | | | |
|---|---|---|---|---|
| 1,667,485 | A | 4/1928 | MacDonald | |
| 1,766,869 | A | 6/1930 | Austin | |
| 2,258,737 | A | 10/1941 | Browne | |
| 2,325,549 | A | 7/1943 | Ryzowitz | |
| 2,480,963 | A | 9/1949 | Quinn | |
| 2,544,654 | A | 3/1951 | Brown | |
| 2,549,647 | A | 4/1951 | Turenne | |
| 2,694,187 | A | 11/1954 | Nash | |
| 2,754,487 | A | 7/1956 | Carr et al. | |
| 2,755,331 | A | 7/1956 | Melcher | |
| 2,757,351 | A | 7/1956 | Klostermann | |
| 2,762,025 | A | 9/1956 | Melcher | |
| 2,805,399 | A | 9/1957 | Leeper | |
| 2,870,420 | A | 1/1959 | Malek | |
| 3,001,169 | A | 9/1961 | Blonder | |
| 3,015,794 | A * | 1/1962 | Kishbaugh | 439/95 |
| 3,091,748 | A | 5/1963 | Takes et al. | |
| 3,094,364 | A | 6/1963 | Lingg | |
| 3,184,706 | A | 5/1965 | Atkins | |
| 3,196,382 | A | 7/1965 | Morello, Jr. | |
| 3,245,027 | A | 4/1966 | Ziegler, Jr. | |
| 3,275,913 | A | 9/1966 | Blanchard et al. | |
| 3,278,890 | A | 10/1966 | Cooney | |
| 3,281,757 | A | 10/1966 | Bonhomme | |
| 3,292,136 | A | 12/1966 | Somerset | |
| 3,320,575 | A | 5/1967 | Brown et al. | |
| 3,321,732 | A | 5/1967 | Forney, Jr. | |
| 3,336,563 | A | 8/1967 | Hyslop | |
| 3,348,186 | A | 10/1967 | Rosen | |
| 3,350,677 | A | 10/1967 | Daum | |

(Continued)

FOREIGN PATENT DOCUMENTS

CA 2096710 A1 11/1994

(Continued)

OTHER PUBLICATIONS

Digicon AVL Connector. ARRIS Group Inc. [online]. 3 pages. [retrieved on Apr. 22, 2010]. Retrieved from the Internet:<URL: http://www.arrisi.com/special/digiconAVL.asp>.

*Primary Examiner* — Phuong Dinh
(74) *Attorney, Agent, or Firm* — Schmeiser Olsen & Watts

(57) ABSTRACT

A coaxial cable connector comprising a connector body attached to a post, wherein the post includes a flange, a port coupling element rotatable about the post, and a continuity member positioned within a cavity, the cavity being located on an outer surface of the flange of the post, wherein the continuity member establishes and maintains electrical and physical contact between the post and the port coupling element. Furthermore, an associated method for maintaining ground continuity with a coaxial cable port is also provided.

20 Claims, 9 Drawing Sheets

U.S. PATENT DOCUMENTS

| | | | |
|---|---|---|---|
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,720,155 | A * | 1/1988 | Schildkraut et al. ..... 439/108 |
| 4,734,050 | A | 3/1988 | Negre et al. |
| 4,734,666 | A | 3/1988 | Ohya et al. |

4,737,123 A 4/1988 Paler et al.
4,738,009 A 4/1988 Down et al.
4,738,628 A * 4/1988 Rees ..... 439/95
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A * 12/1992 Kawai et al. ..... 439/95
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A * 10/1997 Moldenhauer ..... 439/95
5,683,263 A 11/1997 Hse
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.

| | | | | |
|---|---|---|---|---|
| 5,975,949 | A | 11/1999 | Holliday et al. | |
| 5,975,951 | A | 11/1999 | Burris et al. | |
| 5,977,841 | A | 11/1999 | Lee et al. | |
| 5,997,350 | A | 12/1999 | Burris et al. | |
| 6,010,349 | A | 1/2000 | Porter, Jr. | |
| 6,019,635 | A | 2/2000 | Nelson | |
| 6,022,237 | A | 2/2000 | Esh | |
| 6,032,358 | A | 3/2000 | Wild | |
| 6,042,422 | A | 3/2000 | Youtsey | |
| 6,048,229 | A | 4/2000 | Lazaro, Jr. | |
| 6,053,777 | A | 4/2000 | Boyle | |
| 6,083,053 | A * | 7/2000 | Anderson et al. | 439/687 |
| 6,089,903 | A | 7/2000 | Stafford Gray et al. | |
| 6,089,912 | A | 7/2000 | Tallis et al. | |
| 6,089,913 | A | 7/2000 | Holliday | |
| 6,123,567 | A | 9/2000 | McCarthy | |
| 6,146,197 | A | 11/2000 | Holliday et al. | |
| 6,152,753 | A | 11/2000 | Johnson et al. | |
| 6,153,830 | A | 11/2000 | Montena | |
| 6,210,216 | B1 * | 4/2001 | Tso-Chin et al. | 439/545 |
| 6,210,222 | B1 | 4/2001 | Langham et al. | |
| 6,217,383 | B1 | 4/2001 | Holland et al. | |
| 6,239,359 | B1 | 5/2001 | Lilienthal, II et al. | |
| 6,241,553 | B1 | 6/2001 | Hsia | |
| 6,261,126 | B1 | 7/2001 | Stirling | |
| 6,271,464 | B1 | 8/2001 | Cunningham | |
| 6,331,123 | B1 | 12/2001 | Rodrigues | |
| 6,332,815 | B1 | 12/2001 | Bruce | |
| 6,358,077 | B1 | 3/2002 | Young | |
| D458,904 | S | 6/2002 | Montena | |
| 6,406,330 | B2 | 6/2002 | Bruce | |
| D460,739 | S | 7/2002 | Fox | |
| D460,740 | S | 7/2002 | Montena | |
| D460,946 | S | 7/2002 | Montena | |
| D460,947 | S | 7/2002 | Montena | |
| D460,948 | S | 7/2002 | Montena | |
| 6,422,900 | B1 | 7/2002 | Hogan | |
| 6,425,782 | B1 | 7/2002 | Holland | |
| D461,166 | S | 8/2002 | Montena | |
| D461,167 | S | 8/2002 | Montena | |
| D461,778 | S | 8/2002 | Fox | |
| D462,058 | S | 8/2002 | Montena | |
| D462,060 | S | 8/2002 | Fox | |
| 6,439,899 | B1 * | 8/2002 | Muzslay et al. | 439/98 |
| D462,327 | S | 9/2002 | Montena | |
| 6,468,100 | B1 | 10/2002 | Meyer et al. | |
| 6,491,546 | B1 | 12/2002 | Perry | |
| D468,696 | S | 1/2003 | Montena | |
| 6,506,083 | B1 | 1/2003 | Bickford et al. | |
| 6,530,807 | B2 | 3/2003 | Rodrigues et al. | |
| 6,540,531 | B2 | 4/2003 | Syed et al. | |
| 6,558,194 | B2 | 5/2003 | Montena | |
| 6,572,419 | B2 | 6/2003 | Feye-Homann | |
| 6,576,833 | B2 | 6/2003 | Covaro et al. | |
| 6,619,876 | B2 | 9/2003 | Vaitkus et al. | |
| 6,676,446 | B2 | 1/2004 | Montena | |
| 6,683,253 | B1 | 1/2004 | Lee | |
| 6,692,285 | B2 | 2/2004 | Islam | |
| 6,712,631 | B1 | 3/2004 | Youtsey | |
| 6,716,041 | B2 * | 4/2004 | Ferderer et al. | 439/95 |
| 6,716,062 | B1 | 4/2004 | Palinkas et al. | |
| 6,733,336 | B1 | 5/2004 | Montena et al. | |
| 6,733,337 | B2 | 5/2004 | Kodaira | |
| 6,767,248 | B1 | 7/2004 | Hung | |
| 6,780,068 | B2 * | 8/2004 | Bartholoma et al. | 439/752 |
| 6,786,767 | B1 | 9/2004 | Fuks et al. | |
| 6,790,081 | B2 | 9/2004 | Burris et al. | |
| 6,805,584 | B1 | 10/2004 | Chen | |
| 6,817,896 | B2 | 11/2004 | Derenthal | |
| 6,848,939 | B2 | 2/2005 | Stirling | |
| 6,848,940 | B2 | 2/2005 | Montena | |
| 6,884,113 | B1 | 4/2005 | Montena | |
| 6,884,115 | B2 | 4/2005 | Malloy | |
| 6,929,508 | B1 | 8/2005 | Holland | |
| 6,939,169 | B2 | 9/2005 | Islam et al. | |
| 6,971,912 | B2 | 12/2005 | Montena et al. | |
| 7,029,326 | B2 | 4/2006 | Montena | |
| 7,070,447 | B1 | 7/2006 | Montena | |
| 7,086,897 | B2 | 8/2006 | Montena | |
| 7,097,499 | B1 | 8/2006 | Purdy | |
| 7,102,868 | B2 | 9/2006 | Montena | |
| 7,114,990 | B2 | 10/2006 | Bence et al. | |
| 7,118,416 | B2 | 10/2006 | Montena et al. | |
| 7,125,283 | B1 | 10/2006 | Lin | |
| 7,131,868 | B2 | 11/2006 | Montena | |
| 7,147,509 | B1 | 12/2006 | Burris et al. | |
| 7,156,696 | B1 | 1/2007 | Montena | |
| 7,161,785 | B2 | 1/2007 | Chawgo | |
| 7,229,303 | B2 | 6/2007 | Vermoesen et al. | |
| 7,252,546 | B1 | 8/2007 | Holland | |
| 7,255,598 | B2 | 8/2007 | Montena et al. | |
| 7,299,550 | B2 | 11/2007 | Montena | |
| 7,393,245 | B2 | 7/2008 | Palinkas et al. | |
| 7,452,239 | B2 | 11/2008 | Montena | |
| 7,476,127 | B1 | 1/2009 | Wei | |
| 7,479,035 | B2 | 1/2009 | Bence et al. | |
| 7,497,729 | B1 | 3/2009 | Wei | |
| 7,507,117 | B2 | 3/2009 | Amidon | |
| 7,544,094 | B1 | 6/2009 | Paglia et al. | |
| 7,566,236 | B2 | 7/2009 | Malloy et al. | |
| 7,607,942 | B1 | 10/2009 | Van Swearingen | |
| 7,674,132 | B1 | 3/2010 | Chen | |
| 7,682,177 | B2 | 3/2010 | Berthet | |
| 7,727,011 | B2 | 6/2010 | Montena et al. | |
| 7,753,705 | B2 | 7/2010 | Montena | |
| 7,794,275 | B2 | 9/2010 | Rodrigues | |
| 7,806,725 | B1 | 10/2010 | Chen | |
| 7,811,133 | B2 | 10/2010 | Gray | |
| 7,824,216 | B2 | 11/2010 | Purdy | |
| 7,828,595 | B2 | 11/2010 | Mathews | |
| 7,833,053 | B2 | 11/2010 | Mathews | |
| 7,845,976 | B2 | 12/2010 | Mathews | |
| 7,845,978 | B1 | 12/2010 | Chen | |
| 7,850,487 | B1 | 12/2010 | Wei | |
| 7,857,661 | B1 | 12/2010 | Islam | |
| 7,892,005 | B2 | 2/2011 | Haube | |
| 7,892,024 | B1 | 2/2011 | Chen | |
| 7,927,135 | B1 | 4/2011 | Wlos | |
| 7,950,958 | B2 | 5/2011 | Mathews | |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2006/0110977 | A1 | 5/2006 | Mathews | |
| 2006/0154519 | A1 | 7/2006 | Montena | |
| 2007/0026734 | A1 | 2/2007 | Bence et al. | |
| 2008/0102696 | A1 | 5/2008 | Montena | |
| 2009/0029590 | A1 | 1/2009 | Sykes et al. | |
| 2009/0098770 | A1 | 4/2009 | Bence et al. | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0255721 | A1 | 10/2010 | Purdy et al. | |
| 2010/0279548 | A1 | 11/2010 | Montena et al. | |
| 2010/0297871 | A1 | 11/2010 | Haube | |
| 2010/0297875 | A1 | 11/2010 | Purdy | |
| 2011/0021072 | A1 | 1/2011 | Purdy | |
| 2011/0053413 | A1 | 3/2011 | Mathews | |
| 2011/0117774 | A1 | 5/2011 | Malloy et al. | |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |

| | | | |
|---|---|---|---|
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 3280369 | B2 | 5/2002 |
| KR | 100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |

* cited by examiner

CONNECTOR HAVING A CONTINUITY MEMBER

FIELD OF TECHNOLOGY

Electromagnetic signal connectors are used in coaxial cable communication applications, and more specifically embodiments of a coaxial cable connector having a continuity member that extends electrical continuity through the connector facilitate electromagnetic communications.

BACKGROUND

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference. Connectors for coaxial cables are typically connected onto complementary interface ports to electrically integrate coaxial cables to various electronic devices and cable communication equipment. Connection is often made through rotating an internally threaded nut of the connector about a corresponding externally threaded interface port. Fully tightening the threaded connection of the coaxial cable connector to the interface port helps to ensure a ground connection between the connector and the corresponding interface port. However, often connectors are not properly tightened or otherwise installed to the interface port and proper electrical mating of the connector with the interface port does not occur. Moreover, structure of common connectors may permit loss of ground and discontinuity of the electromagnetic shielding that is intended to be extended from the cable, through the connector, and to the corresponding coaxial cable interface port.

Hence, a need exists for an improved connector having a continuity member for ensuring ground continuity through the connector, and establishes and maintains electrical and physical communication between the post and the nut.

SUMMARY

A first general aspect is described as a coaxial cable connector comprising a connector body attached to a post, wherein the post includes a flange, a port coupling element rotatable about the post, and a continuity member positioned within a cavity, the cavity being located on an outer surface of the flange of the post, wherein the continuity member establishes and maintains electrical and physical contact between the post and the port coupling element.

A second general aspect is described as a coaxial cable connector comprising a connector body attached to a post, the post having a first end and opposing second end, wherein the post includes a flange proximate the second end of the post, a port coupling element rotatable about the post, wherein the port coupling element has an internal lip, and a continuity member positioned within a cavity located on an outer surface of the flange of the post, wherein a first portion of the continuity member physically and electrically contacts the coupling element and a second portion of the continuity member physically and electrically contacts the post, and wherein the continuity member facilitates grounding of a coaxial cable through the connector.

A third general is described as a coaxial cable connector comprising a connector body operably attached to a post, the post having a first end and opposing second end, wherein the post includes a flange having a first cavity located on the outer surface of the flange, wherein the first cavity accommodates a first portion of a continuity member, and a second cavity located on the post proximate a second end, wherein the second cavity accommodates a second portion of the continuity member, and a port coupling element operably attached to the post, wherein the coupling element has an internal lip, wherein the continuity member establishes and maintains physical and electrical contact between the port coupling element and the post.

A fourth general aspect is described as a coaxial cable connector comprising a connector body attached to a post, the post having a first end and opposing second end, wherein the post includes a flange proximate the second end of the post, a port coupling element rotatable about the post, wherein the port coupling element has a keyway located on an inner surface of threads of the port coupling element, and a continuity member having a first portion in physical and electrical contact with an underside of the flange, wherein the first portion operably rotates about the flange, and a second portion in physical and electrical contact with a surface of the keyway at a location proximate an outer edge of the port coupling element.

A fifth general aspect is described as a method for maintaining ground continuity comprising providing a coaxial cable connector, the coaxial cable connector including: a connector body rotatable about a post, the post having a first end and opposing second end, wherein the post includes a flange proximate the second end of the post, a port coupling element rotatable about the post, wherein the coupling element has an internal lip; and a continuity member positioned within a cavity located on an outer surface of the flange of the post, wherein a first portion of the continuity member physically and electrically contacts the port coupling element and a second portion of the continuity member physically and electrically contacts the post, and advancing the port coupling element of the connector onto an interface port to ground the connector.

The foregoing and other features of construction and operation as provided in the description will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

Although certain embodiments are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1:
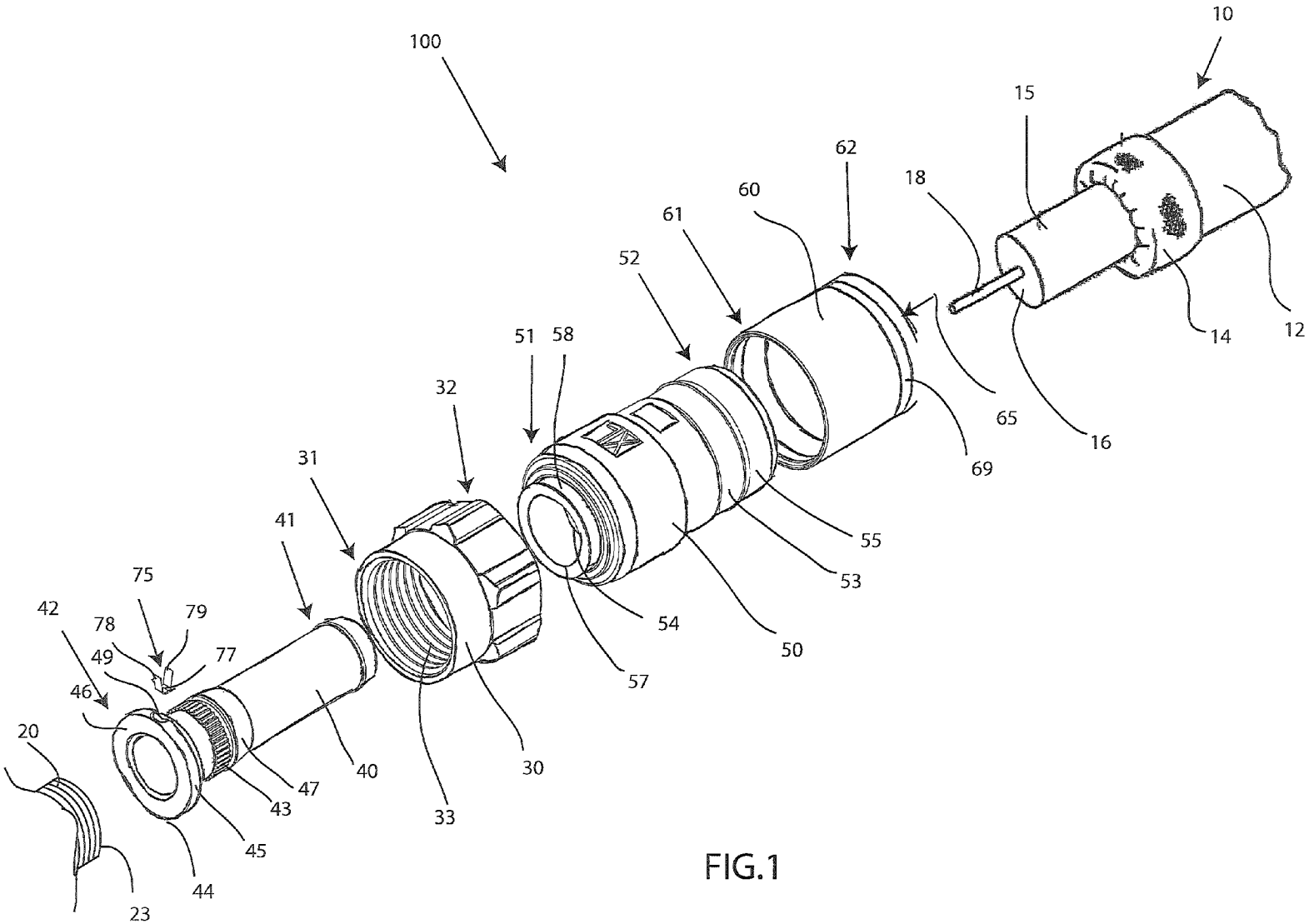
FIG. 1 depicts an exploded perspective view of an embodiment of the elements of an embodiment of a coaxial cable connector having an embodiment of a continuity member.

Referring to the drawings, FIG. 1 depicts one embodiment of a coaxial cable connector 100 having an embodiment of a continuity member 75. The coaxial cable connector 100 may be operably affixed to a coaxial cable 10 so that the cable 10 is securely attached to the connector 100. The coaxial cable 10 may include a protective outer jacket 12, a conductive grounding shield 14, a dielectric foil layer 15, an interior dielectric 16 and a center conductor 18. The coaxial cable 10 may be prepared as embodied in FIG. 1 by removing the protective outer jacket 12 and drawing back the conductive grounding shield 14 to expose a portion of the dielectric foil layer 15 surrounding the interior dielectric 16. Further preparation of the embodied coaxial cable 10 may include stripping the dielectric foil layer 15 and the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, dielectric foil layer 15, interior dielectric 16 and/or center conductor 18 may vary based upon generally recognized parameters corresponding to broadband communication standards and/or equipment.

Referring further to FIG. 1, the connector 100 is configured to attach to a coaxial cable interface port, such as, for example, interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 operable electrical interface with a connector 100. However, the receptacle of the interface port 20 should be formed of a conductive material. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

With continued reference to FIG. 1, an embodiment of a coaxial cable connector 100 may further comprise a port coupling element, such as a nut 30, a post 40, a connector body 50, a fastener member 60, and a continuity member 75 formed of conductive material.

The nut 30, or port coupling element, of embodiments of a coaxial cable connector 100 has a first end 31 and opposing second end 32. The nut 30 may be threaded and may be rotatably secured to the post 40 to allow for rotational movement about the post. The nut 30 may comprise an internal lip 34 (shown in FIG. 2) located proximate, or otherwise near to the second end 32 and configured to hinder axial movement of the post 40. The nut 30 may also comprise internal threading 33 extending axially from the edge of first end 31 a distance sufficient to provide operably effective threadable contact with the external threads 23 of a standard coaxial cable interface port 20. The structural configuration of the nut may vary to accommodate different functionality of a coaxial cable connector 100. For instance, the first end 31 of the nut 30 may include internal and/or external structures such as ridges grooves, curves, detents, slots, openings, chamfers, or other structural features, etc., which may facilitate the operable joining of an environmental sealing member, such as an water-tight seal, that may help preventingress of environmental contaminants at the first end 31 of a nut 30, when mated with an interface port 20. Moreover, the second end 32, of the nut 30 may extend a significant axial distance to reside radially extent of the connector body 50, although the extended portion of the nut 30 need not contact the connector body 50. The nut 30, or port coupling element, includes a generally axial opening, as shown in FIG. 1. The nut 30 may be formed of conductive materials facilitating grounding through the nut 30. Accordingly the nut 30 may be configured to extend an electromagnetic buffer by electrically contacting conductive surfaces of an interface port 20 when a connector 100 is advanced onto the port 20. In addition, the nut 30 may be formed of both conductive and non-conductive materials. For example the external surface of the nut 30 may be formed of a polymer, while the remainder of the nut 30 may be comprised of a metal or other conductive material. The nut 30 may be formed of metals or polymers or other materials that would facilitate a rigidly formed nut body. Manufacture of the nut 30 may include casting, extruding, cutting, knurling, turning, tapping, drilling, injection molding, blow molding, or other fabrication methods that may provide efficient production of the component. Those in the art should appreciate the various embodiments of the nut 30 may also comprise a coupler member having no threads, but being dimensioned for operable connection to a corresponding to an interface port, such as interface port 20.

Referring still to FIG. 1, an embodiment of a connector 100 may include a post 40. The post 40 comprises a first end 41 and opposing second end 42. Furthermore, the post 40 comprises a flange 44, such as an externally extending annular protrusion, located at the second end 42 of the post 40. The flange 44 may include a tapered surface facing the first end 41 of the post 40. Somewhere along the flange 44 is a cavity 49 which can accommodate, house, hold, contain, accept, receive, a continuity member 75. The cavity 49 positioned somewhere along the flange 44 may also be a groove, detent, extrusion, opening, hole, cut-out, space, recess, crater, depression, and the like. For instance, a portion of the flange 44 may be removed, cut-out, etc., forming a cavity 49 to accommodate a continuity member 75. In one embodiment, the cavity 49 may be located proximate the second end 42 of the post 40. In another embodiment, the cavity 49 may be located on the outer surface 45 of the flange 44, adjacent to the surface of the mating edge 46 of the post 40. In yet another embodiment, the cavity 49 may be located on the outer surface 45 of the flange 44, wherein the opening of the cavity 49 faces the first end 41 of the post 40. Moreover, the shape of the cavity 49 may be round, semi-circular, cylindrical, curved, curvilinear, and the like, or alternatively the shape of the cavity 49 may be polygonal, rectangular, square, and the like. Those in the art will appreciate that the cavity 49 and shape thereof may be a combination of a curvilinear shape and polygonal shape cut out of the flange 44. In many embodiments, the shape or volume of the cavity 49 may be such that it may accommodate, house, hold, contain, accept, receive, etc., a continuity member 75. For example, the volume, or internal space, of the cavity 49 must be greater than or equal to a volume required to secure a continuity member 75 within the cavity 49.

Further still, an embodiment of the post 40 may include a surface feature 47 such as a lip or protrusion that may engage a portion of a connector body 50 to secure axial movement of the post 40 relative to the connector body 50. However, the post may not include such a surface feature 47, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features 43, such as ridges, grooves, protrusions, or knurling, which may enhance the secure location of the post 40 with respect to the connector body 50. Additionally, the post 40 may include a mating edge 46, which may be configured to make physical and electrical contact with a corresponding mating edge of an interface port 20. The post 40 should be formed such that portions of a prepared coaxial cable 10 including the dielectric foil layer 15, the dielectric 16 and center conductor 18 can pass axially into the second end 42 and/or through a portion of the tube-like body of the post 40. Moreover, the post 40 should be dimensioned such that the post 40 may be inserted into an end of the prepared coaxial cable 10, around the dielectric foil layer 15 surrounding the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

Figure 2:
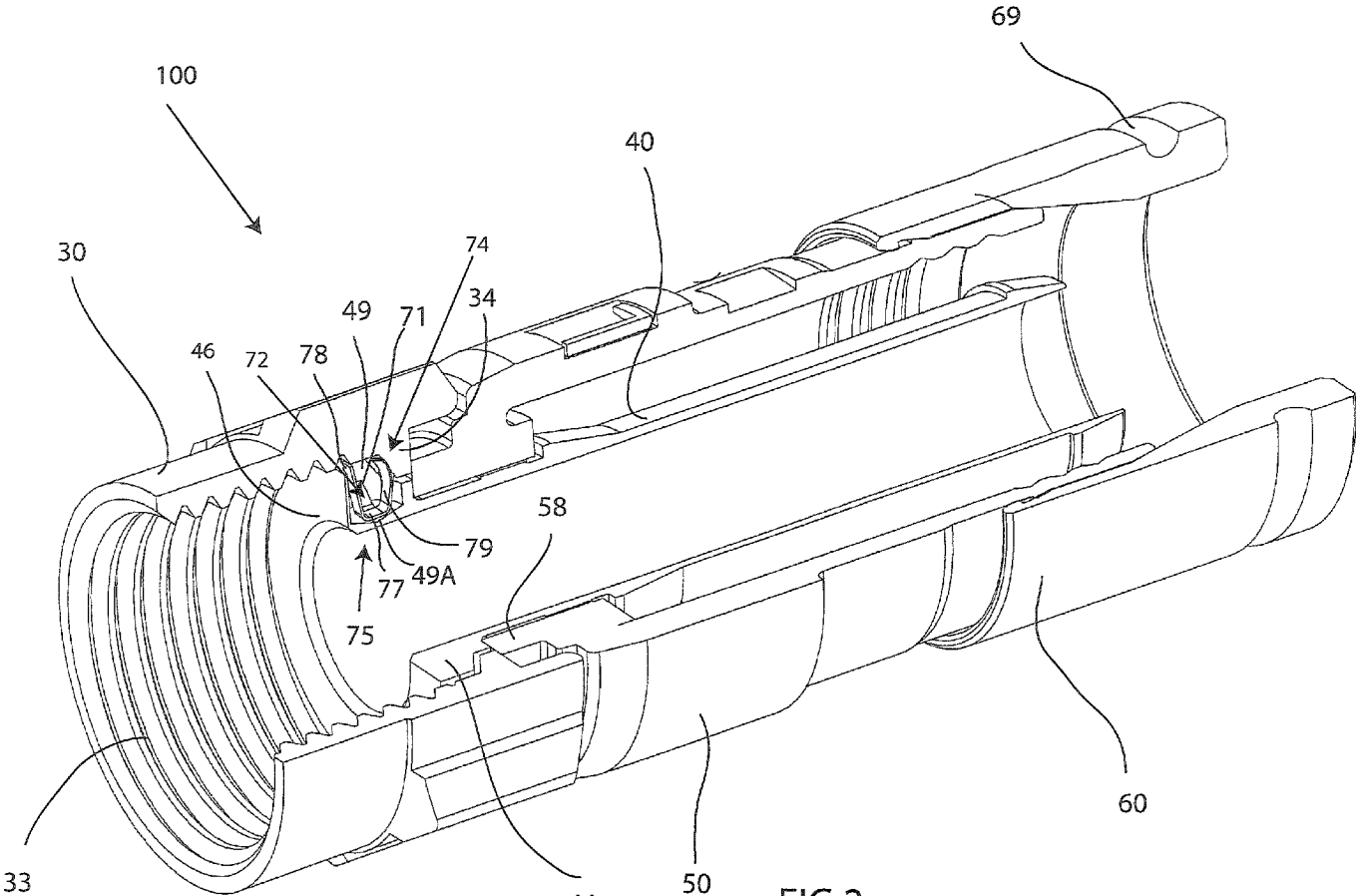
FIG. 2 depicts a perspective cut-away view of an embodiment of the continuity member.
Figure 3:
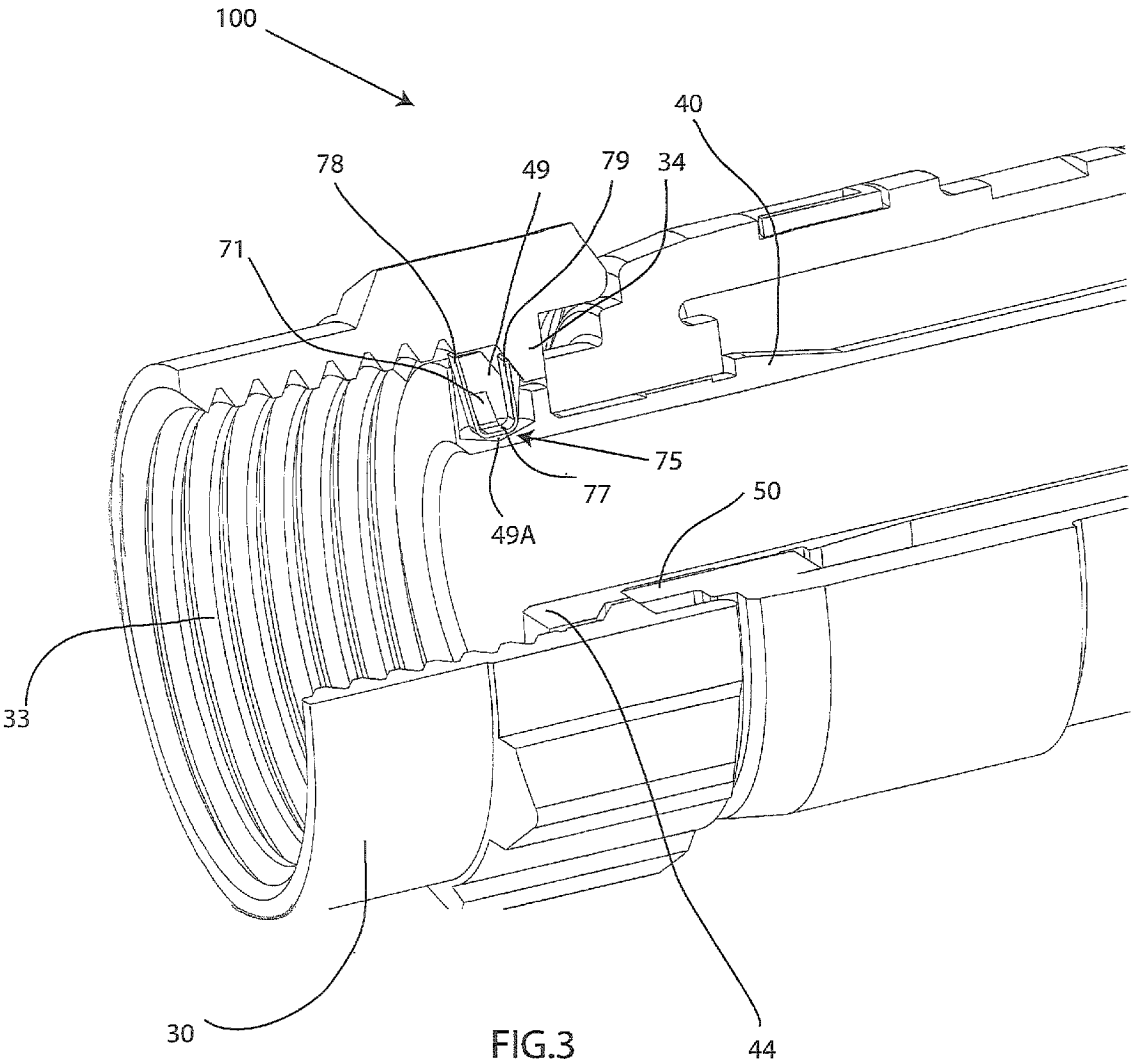
FIG. 3 depicts a perspective cut-away view of a variation of the embodiment of the continuity member.

With continued reference to FIG. 1, an embodiment of a connector 100 may include a continuity member 75, wherein the continuity member 75 maintains electrical ground continuity between the post 40 and the nut 30. A continuity member 75 should be conductive. Moreover, the continuity member 75 may be resilient, pliable, flexible, and the like. In one non-limiting example, the continuity member 75 may be comprised of metal. The continuity member 75 may be a member, element, and/or structure that contacts the post 40 while also contacting the nut 30, thereby establishing and maintaining physical and electrical contact between them. Said contact may be simultaneous, yet independent. For example, as shown in FIG. 2, a first portion 72 of the continuity member 75 may contact the post 40, while simultaneously a second portion 74 contacts the nut 30. Further embodiments of a continuity member 75 may include a base 77, a first wing 78 and a second wing 79. The first wing 78 and the second wing 79 may protrude from the base 77. In one embodiment, the first wing 78 and the second wing 79 may angularly protrude from the base 77. In another embodiment, the first wing 78 and the second wing 79 may perpendicularly protrude from the base 77. The distal end (from the base 77) of the first wing 78 may oppose the distal end of the second wing 79. Each wing 78, 79 may be independently affixed to the base 77 through various connection methods, such as a welded connection. Alternatively, the continuity member 75 may be one, consistent, uniform member that may be formed into a structure including at least one wing 78, and a base 77. Because the continuity member 75 may be resilient, each wing 78, 79 may deform when a mechanical force is applied to the wing 78, 79. For example, the second wing 79 may deform and/or conform to the surface or edge of lip 34 of the nut 30, as shown in FIGS. 2-3, establishing and maintaining physical and electrical contact between the post 40 and the nut 30. In some embodiments, the continuity member 75 may include a third wing 71 adjacent to the first wing 78 and second wing 79 to facilitate physical and electrical contact with the post 40 and nut 30.

The base 77 of the continuity member 75 may be secured or located within the cavity 49, wherein the cavity 49 is located somewhere along the flange 44 of the post 40. For instance, the base 77 of the continuity member 75 may be secured to the bottom surface 49A of the cavity 49, which may be a distance below the outer surface 45 of the flange 44, as shown in FIGS. 1-3. The base 77 may be secured, affixed, adhered, press-fit, attached, friction-fit, placed, located, bonded, and the like with the bottom surface 49A of the cavity 49 by various methods known those skilled in the art, for example, a welded connection, epoxy, bolt, screw, press-fit, and the like. Alternatively, the continuity member 75 need not have its base 77 permanently affixed to the bottom surface 49A within the cavity 49. Radial compression resulting from mechanical forces exerted by the components of the connector 100 while operably assembled may hold and preserve the continuity member 75 in an operable position within the cavity 49, further establishing and maintaining physical and electrical contact with the post 40 and the nut 30.

The location of the continuity member 75 can establish and maintain physical and electrical contact between the post 40 and the nut 30, which can maintain ground continuity throughout the connector 100 to the interface port 20, even though the connector 100 may not be fully tightened around the interface port 20. Connectors 100, such as an F connector, may be grounded by an electrical connection with a conductive outer surface of an interface port 20. Maintaining ground continuity throughout the connector 100 can be accomplished by placing a continuity member 75 in a cavity 49 on the flange 44 of the post 40. The placement and location of the continuity member 75 in a cavity 49 may avoid permanent deformation of the continuity member 75, dislodgement of the continuity member 75, and subsequent loss of continuity. For instance, permanent deformation of a continuity member 75, dislodgement of a continuity member 75, and subsequent loss of continuity may be caused by the axial force generated when tightening the connector 100 into an interface port 20. In other words, when a connector 100 is operably attached or otherwise connected to an interface port 20, in particular, when a nut 30 is tightened around an interface port 20, an exposed continuity member (i.e. member located on surface of post and/or flange) may be crushed, smashed, or pressed (i.e. undergoing an axial force) between the surface of a stationary component (i.e. post 40) and the freely rotating port coupling element (i.e. threaded nut 30). However, placing the continuity member 75 in a cavity 49 may provide relief from the applied axial force because it may avoid being significantly crushed between two components of the connector 100, such as the post 40 and the nut 30. In addition to avoiding deformation and/or damage, placing the continuity member 75 in a cavity 49 on the flange 44 of the post 40 establishes and maintains physical and electrical contact between the post 40 and nut 30, which can maintain ground continuity throughout the connector 100 to the interface port 20. Those having skill in the art should appreciate that the continuity member 75 need not be affixed to the post 40 and simply contact the nut 30, but alternatively may be affixed to the nut 30 while simply contacting the post 40, as shown and described with reference to FIGS. 6-8 infra.

Referring still to FIG. 1, Embodiments of a coaxial cable connector, such as connector 100, may include a connector body 50. The connector body 50 may comprise a first end 51 and opposing second end 52. Moreover, the connector body 50 may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components 50, 40 from moving with respect to each other in a direction parallel to the axis of the connector 100. In addition, the connector body 50 may include an outer annular recess 58 located proximate or near the first end 51 of the connector body 50. Furthermore, the connector body 50 may include a semi-rigid, yet compliant outer surface 55, wherein the outer surface 55 may be configured to form an annular seal when the second end 52 is deformably compressed against a received coaxial cable 10 by operation of a fastener member 60. The connector body 50 may include an external annular detent 53 located proximate or close to the second end 52 of the connector body 50. Further still, the connector body 50 may include internal surface features, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, embodiments of a coaxial cable connector 100 may include a fastener member 60. The fastener member 60 may have a first end 61 and opposing second end 62. In addition, the fastener member 60 may include an internal annular protrusion located proximate the first end 61 of the fastener member 60 and configured to mate and achieve purchase with the annular detent 53 on the outer surface 55 of connector body 50. Moreover, the fastener member 60 may comprise a central passageway 65 defined between the first end 61 and second end 62 and extending axially through the fastener member 60. As shown in FIG. 2, the central passageway 65 may comprise a ramped surface which may be positioned between a first opening or inner bore having a first diameter positioned proximate with the first end 61 of the fastener member 60 and a second opening or inner bore having a second diameter positioned proximate with the second end 62 of the fastener member 60. The ramped surface may act to deformably compress the outer surface 55 of a connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the nut 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

The manner in which the coaxial cable connector 100 may be fastened to a received coaxial cable 10 may also be similar to the way a cable is fastened to a connector having an insertable compression sleeve that is pushed into the connector body 50 to squeeze against and secure the cable 10. The coaxial cable connector 100 includes an outer connector body 50 having a first end 51 and a second end 52. The body 50 at least partially surrounds a tubular inner post 40. The tubular inner post 40 has a first end 41, the first end 41 including a flange 44, and a second end 42, the second end 42 configured to mate with a coaxial cable 10 and contact a portion of the outer conductive grounding shield or sheath 14 of the cable 10. The connector body 50 is secured to the tubular post 40, such that the connector body engages a portion of the tubular post 40 proximate or close to the first end 41 of the tubular post 40. The connector body 50 coaxially cooperates with, or otherwise is functionally located in a radially spaced relationship with the inner post 40 to define an annular chamber with a rear opening. A tubular locking compression member, or fastener member 60, may protrude axially into the annular chamber through its rear opening. The tubular locking compression member may be slidably coupled or otherwise movably affixed to the connector body 50 to compress into the connector body and retain the cable 10 and may be displaceable or movable axially or in the general direction of the axis of the connector 100 between a first open position (accommodating insertion of the tubular inner post 40 into a prepared cable 10 end to contact the grounding shield 14), and a second clamped position compressibly fixing the cable 10 within the chamber of the connector 100, because the compression sleeve, or fastener member 60, is squeezed into retraining contact with the cable 10 within the connector body 50. A port coupling element, or nut 30, at the front end of the inner post 40, when assembled as in FIG. 2, serves to attach the connector 100 to an interface port. In a connector having an insertable compression sleeve, the structural configuration and functional operation of the nut 30 may be similar to the structure and functionality of similar components of a connector 100, 200, 300 and/or 400 described in FIGS. 1-9, and having reference numerals denoted similarly.

Figure 4:
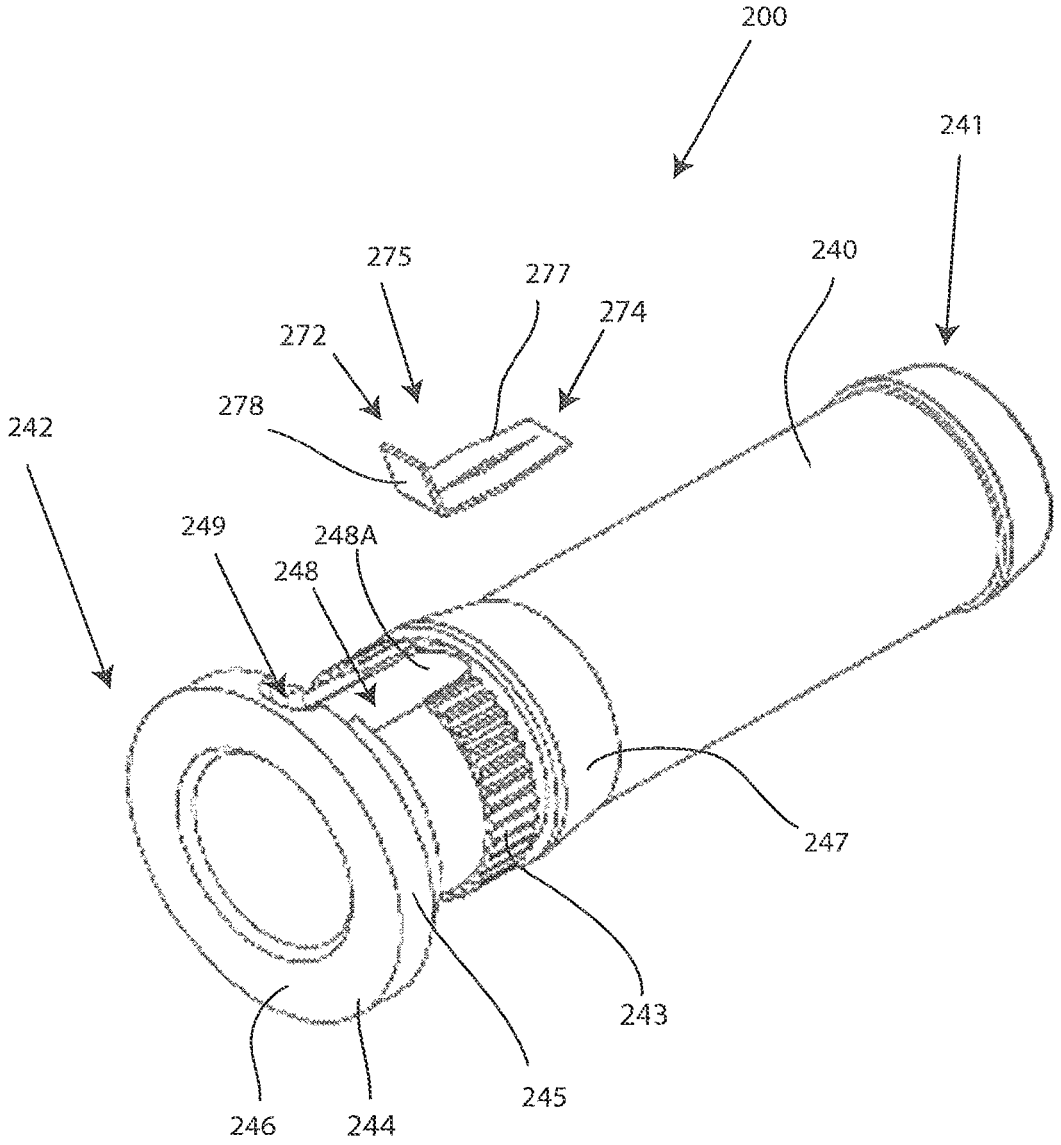
FIG. 4 depicts a perspective view of an embodiment of a post having a post cavity and an embodiment of a continuity member.
Figure 5:
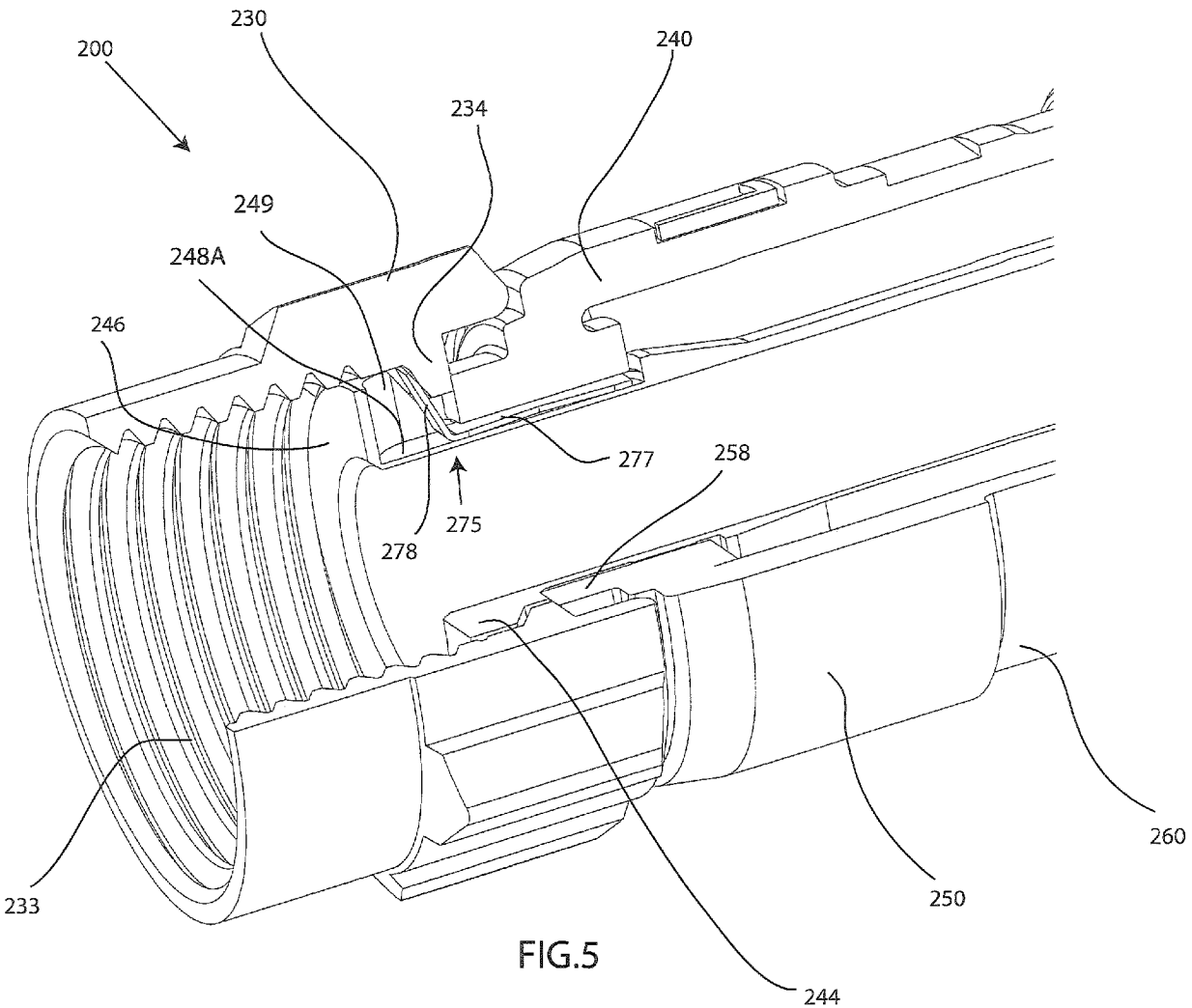
FIG. 5 depicts a perspective cut-away view of an embodiment of a continuity member positioned within a cavity.

Turning now to FIG. 4, a connector 200 may include a continuity member 275 which may be an L-shaped member having a wing 278 and a base 277, wherein a first portion 272 of the continuity member 275 may reside in cavity 249, and a second portion 274 of the continuity member 275 may reside in post cavity 248. Continuity member 275 should be conductive. Moreover, the continuity member 275 may be resilient, pliable, flexible, and the like. In one non-limiting example, the continuity member 275 may be comprised of metal. The continuity member 275 may be a member, element, and/or structure that contacts the post 240 while also contacting the nut 230, as shown in FIG. 5, thereby establishing and maintaining physical and electrical contact between the nut 230 and post 40. Said contact may be simultaneous, yet independent. For example, a first portion 272 of the continuity member 275 may contact the post 240, while a second portion 274 simultaneously contacts the nut 230. Furthermore, wing 278 may perpendicularly or angularly protrude from base 277 to establish and maintain contact with the nut 230. Wing 278 may be affixed to the base 277 through various connection methods, such as a welded connection. Alternatively, the continuity member 275 may be one, consistent, uniform member that may be formed, bent, molded, etc., into any shape that facilitates electrical and physical communication between the post 240 and the nut 230. Because the continuity member 275 may be resilient, wing 278 may deform when a mechanical force is applied to the wing 278. For example, as shown in FIG. 5, the wing 278 may deform and/or conform to the surface or edge of lip 234 of the nut 230, establishing and maintaining physical and electrical contact between the post 240 and the nut 230.

Moreover, the base 277 of the continuity member 275 may be secured or located within the post cavity 248, wherein the post cavity 248 is located somewhere along the post 240. In many embodiments, the post cavity 248 may be located proximate the flange 244. For instance, the base 277 of the continuity member 275 may be secured or positioned to contact the bottom surface 248A of the post cavity 248. The post cavity 248 may be a cavity, recess, detent, trough, space, opening, hole, extrusion, depression, and the like. Additionally, the post cavity 248 may be formed by a cut-out, extrusion, or space created by the removal of a section of the surface features 243, such as ridges, grooves, protrusions, or knurling on the exterior surface of the post 240. The shape or outline of the post cavity 248 may correspond with the shape of the base 277. In one embodiment, the shape or perimeter of the post cavity 248 may be slightly larger than the shape or perimeter of the base 277 to accommodate, house, contain, hold, accept, receive, etc., the base 277 of continuity member 275. Those having skill in the art will recognize that the depth of the post cavity 248 may be enough to sufficiently allow the base 277 to fit inside and become flush with the exterior surface of the post 240. Minor deviations in the placement of the continuity member 275, such as the base 277 being slightly above or below the exterior surface of the post 240, may occur without substantially affecting the performance of the continuity member 275. The base 277 may be secured, affixed, adhered, press-fit, attached, placed, located, bonded, and the like with the bottom surface 248A of the post cavity 248 by various methods known those skilled in the art, for example, a welded connection, epoxy, bolt, screw, press-fit, and the like. Alternatively, the continuity member 275 need not have its base 277 permanently affixed to the bottom surface 248A within the post cavity 248. For example, radial compression resulting from mechanical forces exerted by the components of the connector 100 while operably assembled may hold and preserve the continuity member 275 in an operable position within the post cavity 248, further establishing and maintaining physical and electrical contact with the post 240 and the nut 230.

While the base 277 resides in the post cavity 248, the wing 278 may reside in a cavity 249 located on the outer surface 245 of the flange 244. The cavity 249 may accommodate, house, hold, contain, accept, receive, etc., the continuity member 275, in particular, the wing 278. The cavity 249 may also be a groove, detent, extrusion, opening, hole, cut-out, space, recess, crater, depression, and the like. For instance, a portion of the flange 244 may be removed, cut-out, extruded, etc., forming a cavity 249 to accommodate a portion of the continuity member 275. In one embodiment, the cavity 249 may be located proximate the second end 242 of the post 240. In another embodiment, the cavity 249 may be located on the outer surface 245 of the flange 244, adjacent to surface of the mating edge 246 of the post 240. In yet another embodiment, the cavity 249 may be located on the outer surface 245 of the flange 244, wherein the opening of the cavity 249 faces the first end 241 of the post 240. Moreover, the shape of the cavity 249 may be round, semi-circular, cylindrical, curved, curvilinear, and the like, or alternatively the shape of the cavity 249 may be polygonal, rectangular, square, and the like. Those in the art will appreciate that the cavity 249 may be a combination of a curvilinear shape and polygonal shape cut out of the flange 244. In many embodiments, the shape or volume of the cavity 249 may be such that it may accommodate, house, hold, contain, accept, receive, etc., a portion of the continuity member 275. For example, the volume, or internal space, of the cavity 249 must be greater than or equal to a volume required to secure, hold, accommodate, house, receive, accept, etc., a portion of the continuity member 275 within the cavity 249.

The location of the continuity member 275 can establish and maintain physical and electrical contact between the post 240 and the nut 230, which can maintain ground continuity throughout the connector 200 to the interface port 20. Connectors 200, such as an F connector, may be grounded by an electrical connection with a conductive outer surface of an interface port 20. Maintaining ground continuity throughout the connector 200 may be accomplished by placing a portion, or wing 278 of a continuity member 275 in a cavity 249 on the flange 244 of the post 240, and another portion, or base 277, of a continuity member 275 in a post cavity 248, as shown in FIG. 4 and FIG. 5. The placement and location of the continuity member 275 may avoid permanent deformation of the continuity member 275, dislodgement of the continuity member 275, and subsequent loss of continuity. For instance, permanent deformation of a continuity member 275, dislodgement of a continuity member 275, and subsequent loss of continuity may be caused by the axial force generated when tightening the connector 200 into an interface port 20. In other words, when a connector 200 is operably attached or otherwise connected to an interface port 20, in particular, when the nut 230 is tightened around an interface port 20, an exposed continuity member (i.e. member located on and extending above the surface of post and/or flange) may be crushed, smashed, or pressed (i.e. undergoing an axial force) between the surface of a stationary component (i.e. post 240) and the freely rotating coupling element (i.e. threaded nut 230). However, placing a portion of the continuity member 275 in a cavity 249 and another portion of the continuity member 275 in a post cavity 248 may provide relief from the applied axial force because it may avoid being significantly crushed between two components of the connector 200, such as the post 240 and the nut 230. In addition to avoiding deformation and/or damage, placing a first portion 272 of the continuity member 275 in a cavity 249 on the flange 244 of the post 240 and a second portion 274 of the continuity member 275 in a post cavity 248 establishes and maintains physical and electrical contact between the post 240 and nut 230, which can maintain ground continuity throughout the connector 200 to the interface port 20.

Figure 6:
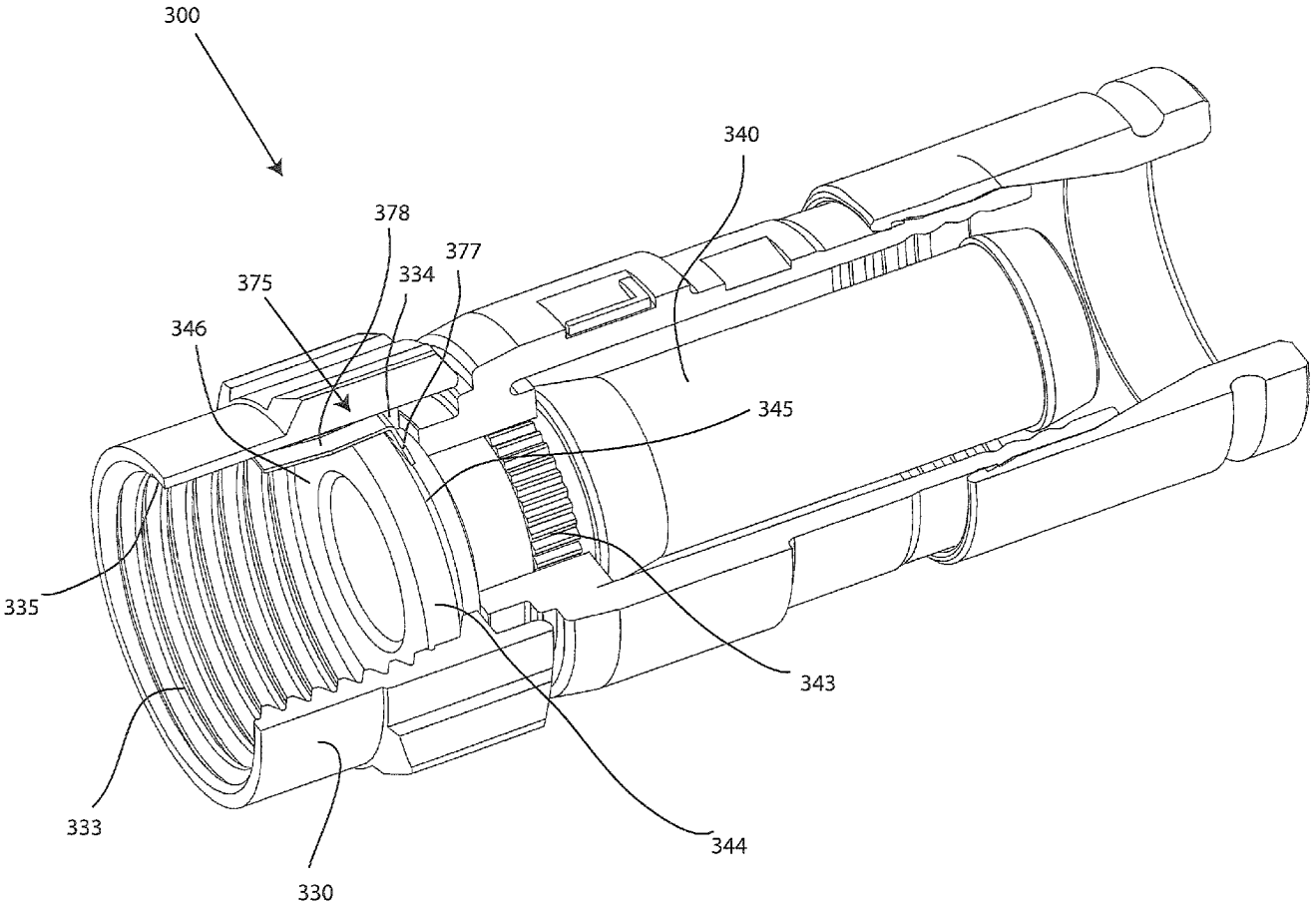
FIG. 6 depicts a perspective cut-away view of an embodiment of a continuity member positioned on the under-surface of a flange.
Figure 7:
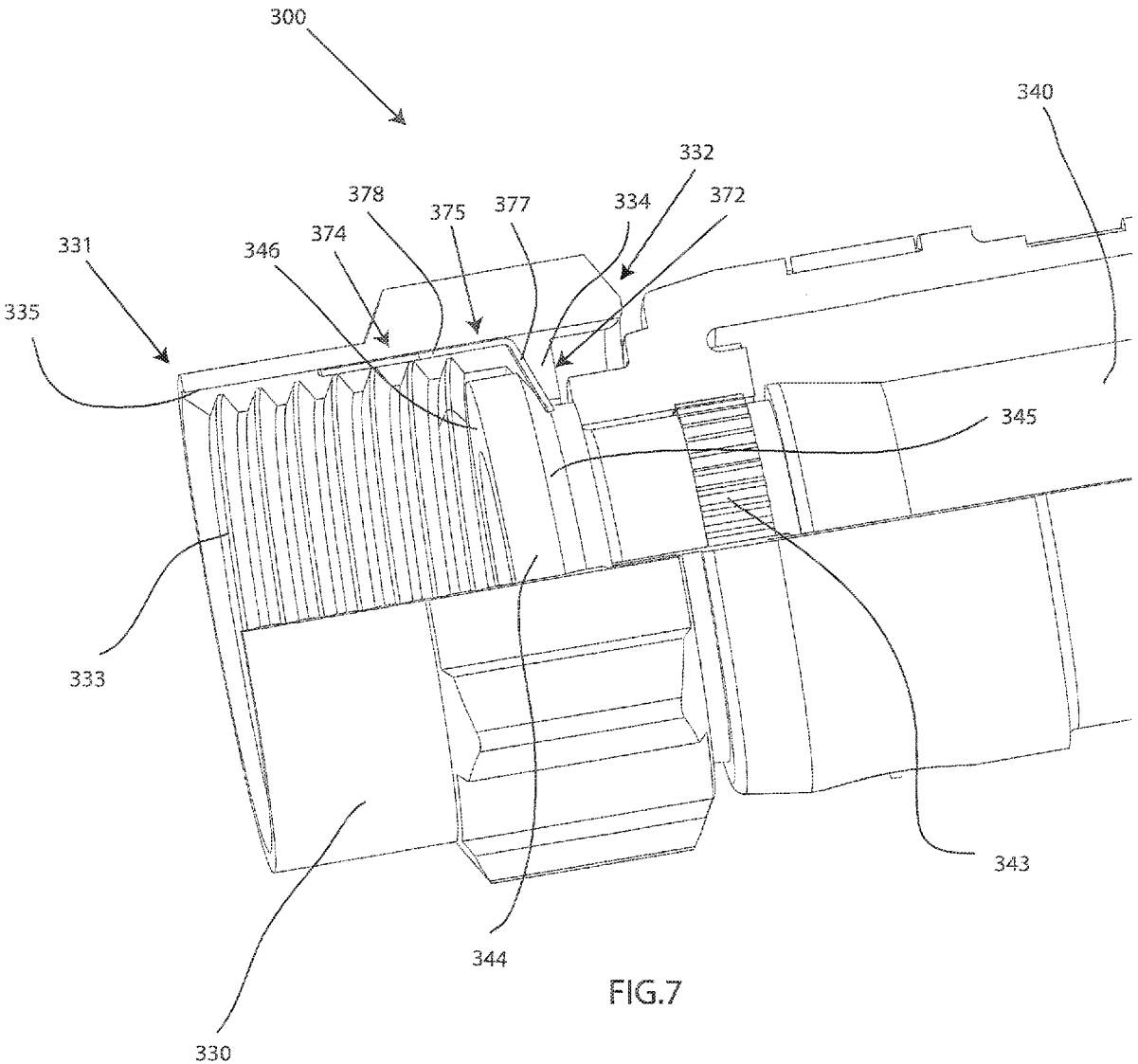
FIG. 7 depicts a perspective cut-away view of an embodiment of a continuity member positioned proximate the flange.
Figure 8:
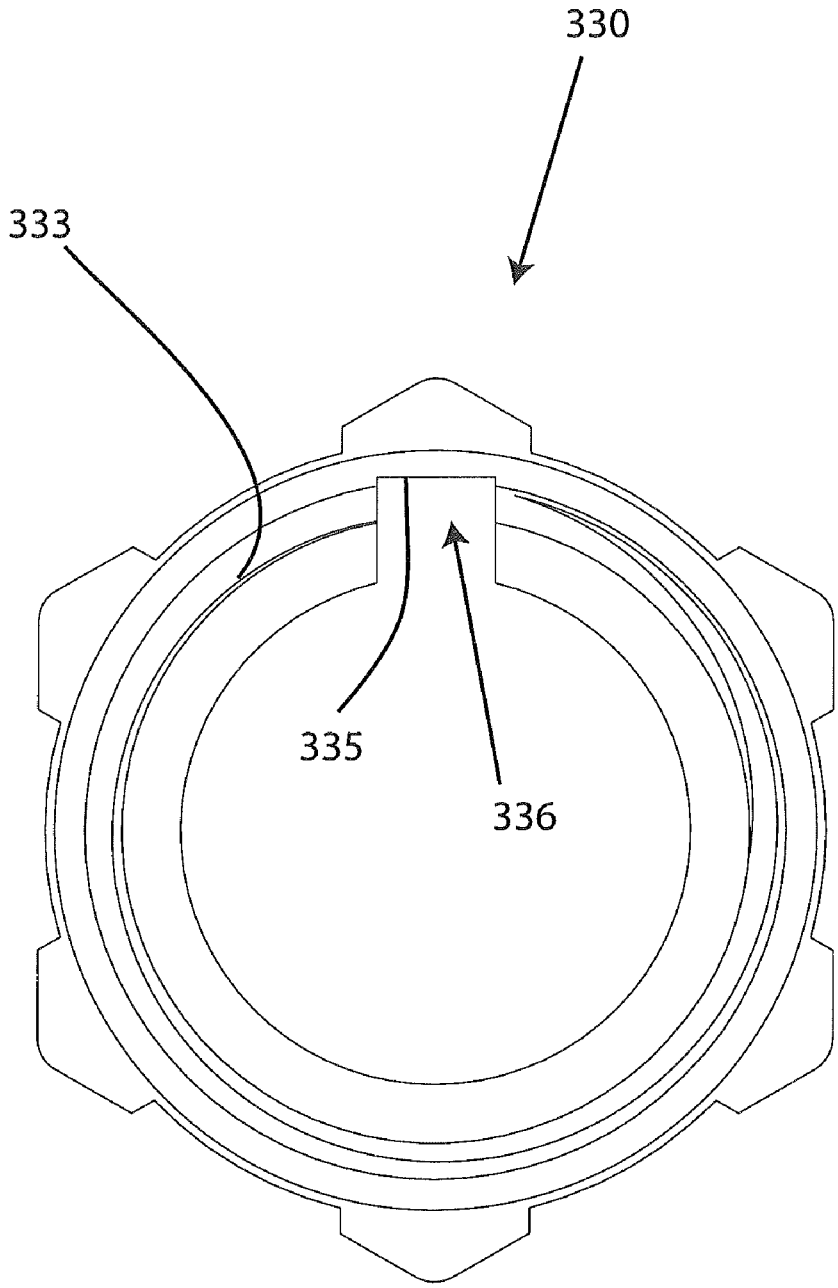
FIG. 8 depicts an end view of an embodiment of a coupling member having a keyway positioned therein.

Referring now to FIGS. 6-8, a continuity member 375 may be positioned proximate or otherwise near the flange 344 of the post 340, wherein a first portion 372 of the continuity member 375 contacts the underside 345 of flange 344 and a second portion 374 of the continuity member 375 contacts an inner surface 335 of a port coupling element, such as nut 330. For instance, nut 330 may include a keyway 336 that may begin from the second end 332 and extend a distance towards the first end 331. The keyway 336 may not extend the entire distance from the second end 332 to the first end 331. For example, the keyway 336 may extend toward the first end 331 a distance that corresponds to the length of wing 378 of the continuity member 375, such that the wing 378 fits snugly or otherwise within the parameters of the keyway 336. However, FIG. 8 depicts an embodiment of a nut 330 having a keyway 336 that extends the entire length of the nut 330, in particular, extending from the second end 332 to the first end 331. The keyway 336 may be an opening, notch, trough, channel, cut-out, groove, path, passage, detent, and/or slot located on inside diameter of the nut 330. For instance, a portion of the threads 333 may be removed, cut-out, formed, etc., to reveal a substantially smooth inner surface 335, wherein the inner surface 335 is a distance below the surface of the threads 333, as depicted in FIG. 8. In other words, the keyway 336 may create a volume, or space, extending axially through the threads 333, wherein the space created by the keyway 336 may house, receive, hold, accommodate, etc., a portion of the continuity member 375. The keyway 336 may increase an internal diameter of the port coupling element, or nut 330, a distance equal to the width of the keyway 336 because the inner surface 335 may not be flush with the threads 333. For instance, the keyway 336 may prevent the internal diameter of the nut 330 from being substantially similar at all points along the inner circumference of the nut 330. In one embodiment, the keyway 336 may accommodate a wing 378 of the continuity member 375, wherein the wing 378 directly contacts the inner surface 335 of the nut 330 located within the keyway 336. In another embodiment, the keyway 336 may accommodate a second portion 374 of the continuity member 375, wherein a first portion 372 of the continuity member 375 is located about the flange 344. Moreover, the contact between the wing 378, or a second portion 374 of the continuity member 375, and the inner surface 335 of the nut 330 may establish and maintain physical and electrical communication between the post 340 and nut 330. Physical and electrical contact can be established and maintained between the post 340 and the nut 330 because the wing 378 or second portion 374 of the continuity member 375 contacts the nut 330, while the base 377 or a first portion 372 of the continuity member 375 independently and simultaneously contacts the post 340. The base 377 of the continuity member 375 may directly contact the underside 345 of the flange 344, as shown in FIG. 6 and FIG. 7. The underside 345 of the flange 344 may be a tapered surface, which can facilitate and/or ensure adequate and consistent contact with the base 377.

The wing 378, or second portion 374, of the continuity member 375 may be secured or located within the keyway 336, wherein the keyway 336 is located somewhere along inside diameter of the nut 330. For instance, the wing 378 of the continuity member 375 may be secured to the inner surface 335 of the nut 330, which may be a distance below the surface of the threads 333. The wing 378 may be secured, affixed, adhered, press-fit, attached, placed, located, bonded, and the like to the inner surface 335 by various methods known those skilled in the art, for example, a welded connection, epoxy, bolt, screw, press-fit, and the like. Alternatively, the continuity member 375 need not have its wing 378 permanently affixed to the inner surface 335 within the keyway 336. Radial compression resulting from mechanical forces exerted by the components of the connector 300, such as a coupled interface port, while operably assembled may hold and preserve the continuity member 375 in an operable position within the keyway 336, further establishing and maintaining physical and electrical contact between the post 340 and the nut 330. Furthermore, the continuity member 375 should be conductive, and may be resilient, pliable, flexible, and the like. In one non-limiting example, the continuity member 375 may be comprised of metal.

During operation of the connector 300, the nut 330, or coupling element, may be rotated for coupling with a port, such as interface port 20, which may result in the nut 330 rotating about the post 340. Lateral movement of the wing 378, or second portion 374 of the continuity member 375, may be restricted and/or prevented when located within the keyway 336 by the parameters or side walls of the keyway 336. Thus, the base 377, or first portion 372 of continuity member 375 may rotate about the flange 344 as the nut 330 rotates to avoid any damage or permanent deformation to the continuity member 375. For example, the base 377 may rotate around the flange 344 while maintaining physical contact with the underside 345 of the flange 344.

Furthermore, the location of the continuity member 375 can establish and maintain physical and electrical contact between the post 340 and the nut 330, which may maintain ground continuity throughout the connector 300 to the interface port 20. Connectors 300, such as an F connector, may be grounded by an interaction with an interface port 20. The placement and location of a portion of the continuity member 375 in a keyway 336 through the threads 333 of nut 330 may avoid permanent deformation of the continuity member 375, dislodgement of the continuity member 375, and subsequent loss of continuity. For instance, permanent deformation of a continuity member 375, dislodgement of a continuity member 375, and subsequent loss of continuity may be caused by the axial force generated when tightening the connector 300 onto an interface port 20. In other words, when a connector 300 operably attaches to a port 20, in particular, when the nut 330 is tightened around an interface port 20, an exposed continuity member (e.g. member located on threads 333) may be crushed, smashed, or pressed (i.e. undergoing an axial force) between the surface of a stationary component (i.e. port 20) and the freely rotating coupling element (i.e. threaded nut 330). However, placing a portion of the continuity member 375 in a keyway 336 may provide relief from the applied axial force because it may avoid being significantly crushed between two components of the connector 300, such as the port 20 and the nut 330. In addition to avoiding deformation and/or damage, placing a portion of the continuity member 375 in a keyway 336 on the nut 330 and another portion on the underside 345 of the flange 344 may establish and maintains physical and electrical contact between the post 340 and nut 330, which may maintain ground continuity throughout the connector 300 to the interface port 20.

Figure 9:
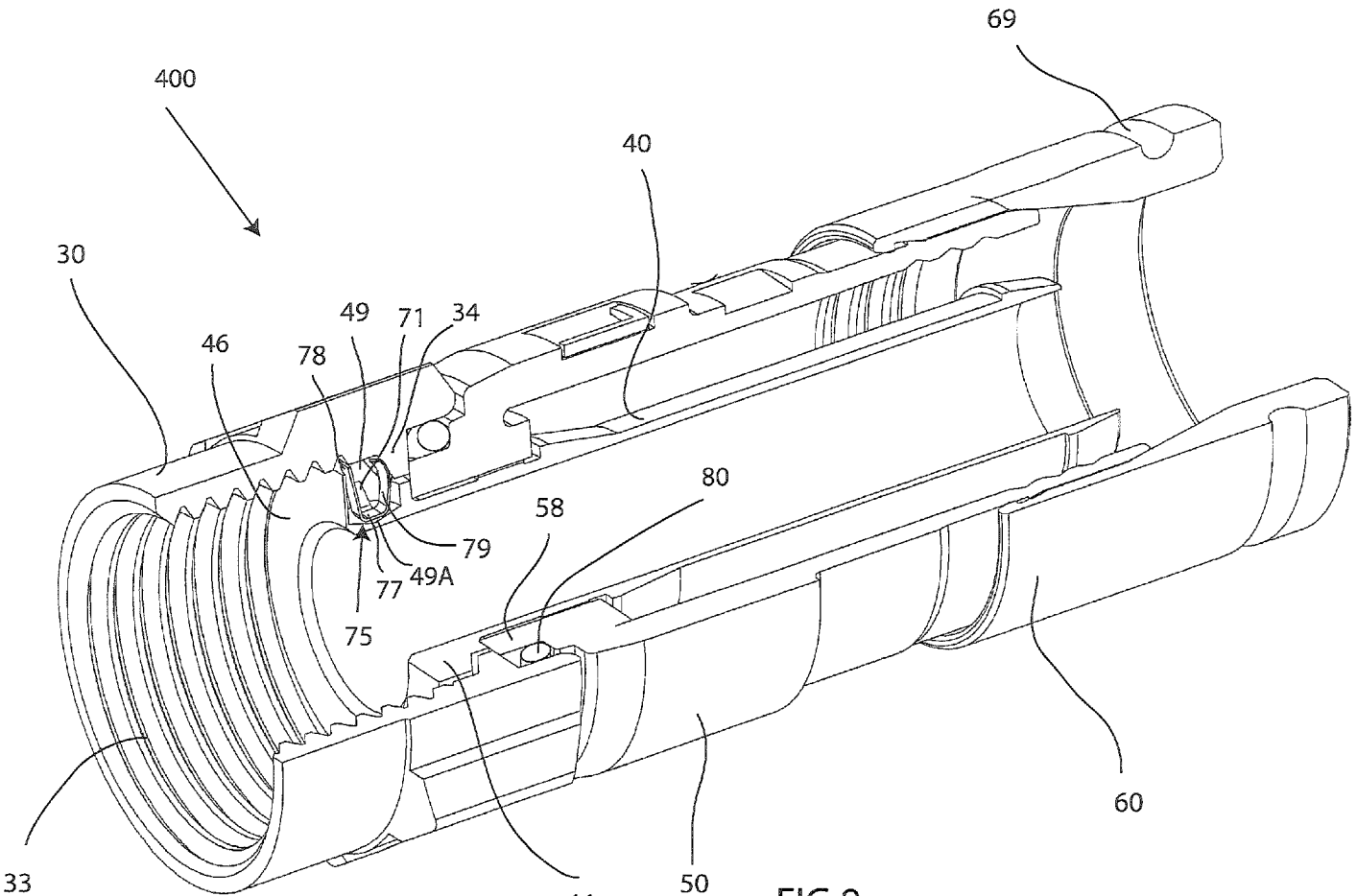
FIG. 9 depicts a perspective cut-away view of an embodiment of a connector having a continuity member and a body sealing member.

With further reference to FIGS. 1-9, connector 400 may include a continuity member 75, 275, or 375, and may also include a body sealing member 80, such as an O-ring, shown particularly in FIG. 9. Body sealing member 80 may be located proximate the second end portion 37 of the nut 30 in front of the internal lip 34 of the nut 30, so that the sealing member 80 may compressibly rest between the nut 30 and the connector body 50. The body sealing member 80 may fit snugly over the portion of the body 50 corresponding to the annular recess 58 proximate the first end 51 of the body 50. However, those in the art should appreciate that other locations of the sealing member 80 corresponding to other structural configurations of the nut 30 and body 50 may be employed to operably provide a physical seal and barrier to ingress of environmental contaminants. For example, body embodiments of a body sealing member 80 may be structured and operably assembled with a coaxial cable connector 100 to prevent contact between the nut 30 and the connector body 50.

Referring back to FIGS. 1-9, a method for maintaining ground continuity with a port 20 may comprise the steps of providing a coaxial cable connector 100, the coaxial cable connector 100 including a connector body 50 rotatable about a post 40, the post 40 having a first end 41 and opposing second end 42, wherein the post 40 includes a flange 44 proximate the second end 42 of the post 40, a port coupling element 30 rotatable about the post 40, wherein the port coupling element 30 has an internal lip 34; and a continuity member 75 positioned within a cavity 49 located on an outer surface 45 of the flange 44 of the post 40, wherein a first portion 72 of the continuity member 75 physically and electrically contacts the port coupling element 30 and a second portion 74 of the continuity member 75 physically and electrically contacts the post 40, and advancing the port coupling element 30 of the connector 100 onto an interface port 20 to ground the connector 100. The method may include steps with reference to the multiple embodiments described herein. For example, a method of maintaining ground continuity may incorporate aspects of connectors 100, 200, 300, and 400, either in whole or in part.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A coaxial cable connector comprising:
a connector body attached to a post, wherein the post includes a flange;
a port coupling element rotatable about the post; and
a continuity member positioned within a cavity, the cavity being located on an outer surface of the flange of the post;
wherein the continuity member establishes and maintains electrical and physical contact between the post and the port coupling element.

2. The connector of claim 1, wherein a portion of the continuity member contacts a bottom surface of the cavity.

3. The connector of claim 1, wherein the continuity member has at least one wing and a base, further wherein the at least one wing protrudes from the base.

4. The connector of claim 1, wherein at least a portion of the continuity member is resilient.

5. The connector of claim 1, wherein the at least one wing deformably conforms to an internal lip of the port coupling element.

6. A coaxial cable connector comprising:
a connector body attached to a post, the post having a first end and opposing second end, wherein the post includes a flange proximate the second end of the post;
a port coupling element rotatable about the post, wherein the port coupling element has an internal lip; and
a continuity member positioned within a cavity located on an outer surface of the flange of the post, wherein a first portion of the continuity member physically and electrically contacts the coupling element and a second portion of the continuity member physically and electrically contacts the post; and
wherein the continuity member facilitates grounding of a coaxial cable through the connector.

7. The connector of claim 6, wherein the first portion of the continuity member deformably conforms to the internal lip of the port coupling element.

8. The connector of claim 6, further comprising:
a sealing member located proximate a second end portion of the port coupling element proximate the internal lip of the port coupling element.

9. The connector of claim 6, wherein at least a portion of the continuity member is resilient.

10. A coaxial cable connector comprising:

a connector body operably attached to a post, the post having a first end and opposing second end, wherein the post includes a flange having a first cavity located on the outer surface of the flange, wherein the first cavity accommodates a first portion of a continuity member, and a second cavity located on the post proximate a second end, wherein the second cavity accommodates a second portion of the continuity member; and a port coupling element operably attached to the post, wherein the coupling element has an internal lip;

wherein the continuity member establishes and maintains physical and electrical contact between the port coupling element and the post.

11. The connector of claim 10, wherein the first portion of the continuity member deformably conforms to the internal lip of the port coupling element.

12. The connector of claim 10, further comprising:

a sealing member located proximate a second end portion of the port coupling element proximate the internal lip of the port coupling element.

13. The connector of claim 10, wherein at least a portion of the continuity member is resilient.

14. A coaxial cable connector comprising:

a connector body attached to a post, the post having a first end and opposing second end, wherein the post includes a flange proximate the second end of the post;

a port coupling element rotatable about the post, wherein the port coupling element has a keyway located on an inner surface of threads of the port coupling element; and a continuity member having a first portion in physical and electrical contact with an underside of the flange, wherein the first portion rotates about the flange, and a second portion in physical and electrical contact with a surface of the keyway at a location proximate an outer edge of the port coupling element.

15. The connector of claim 14, further comprising:

a sealing member located proximate a second end portion of the port coupling element proximate the internal lip of the port coupling element.

16. The connector of claim 14, wherein at least a portion of the continuity member is resilient.

17. A method for maintaining ground continuity with a port comprising:

providing a coaxial cable connector, the coaxial cable connector including:

a connector body rotatable about a post, the post having a first end and opposing second end, wherein the post includes a flange proximate the second end of the post, a port coupling element rotatable about the post, wherein the port coupling element has an internal lip; and a continuity member positioned within a cavity located on an outer surface of the flange of the post;

wherein a first portion of the continuity member physically and electrically contacts the port coupling element and a second portion of the continuity member physically and electrically contacts the post; and advancing the port coupling element of the connector onto an interface port to ground the connector.

18. The method of claim 17, wherein the first portion of the continuity member deformably conforms to the internal lip of the coupling element.

19. The method of claim 17, further comprising:

providing a sealing member located proximate a second end portion of the port coupling element proximate the internal lip of the port coupling element.

20. The method of claim 17, wherein the continuity member is resilient.

* * * * *